US010249316B2

(12) United States Patent
Song et al.

(10) Patent No.: US 10,249,316 B2
(45) Date of Patent: Apr. 2, 2019

(54) ROBUST NOISE ESTIMATION FOR SPEECH ENHANCEMENT IN VARIABLE NOISE CONDITIONS

(71) Applicant: Continental Automotive Systems, Inc., Auburn Hills, MI (US)

(72) Inventors: Jianming Song, Barrington, IL (US); Bijal Joshi, Elk Grove Village, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 40 days.

(21) Appl. No.: 15/700,085

(22) Filed: Sep. 9, 2017

(65) Prior Publication Data

US 2018/0075859 A1 Mar. 15, 2018

Related U.S. Application Data

(60) Provisional application No. 62/385,464, filed on Sep. 9, 2016.

(51) Int. Cl.

| | |
|---|---|
| ***G10L 21/02*** | (2013.01) |
| ***G10L 21/0216*** | (2013.01) |
| ***G10L 19/06*** | (2013.01) |
| ***G10L 21/0264*** | (2013.01) |
| ***G10L 21/0208*** | (2013.01) |
| ***G10L 25/84*** | (2013.01) |
| *G10L 25/12* | (2013.01) |

(52) U.S. Cl.

CPC ..... *G10L 21/0216* (2013.01); *G10L 19/06* (2013.01); *G10L 21/0208* (2013.01); *G10L 21/0264* (2013.01); *G10L 25/84* (2013.01); *G10L 25/12* (2013.01)

(58) Field of Classification Search

USPC ..... 704/200–230, 500–504

See application file for complete search history.

(56) References Cited

U.S. PATENT DOCUMENTS

| | | | | |
|---|---|---|---|---|
| 5,680,508 | A | 10/1997 | Liu | |
| 6,862,567 | B1 * | 3/2005 | Gao | G10L 21/0208 704/225 |
| 7,725,315 | B2 | 5/2010 | Hetherington et al. | |
| 2008/0133226 | A1 | 6/2008 | Huang et al. | |
| 2016/0155457 | A1 | 6/2016 | Bruhn | |

FOREIGN PATENT DOCUMENTS

| | | | |
|---|---|---|---|
| EP | 0762386 | A2 | 3/1997 |
| WO | 99/35638 | A1 | 7/1999 |

OTHER PUBLICATIONS

Search Report dated Mar. 17, 2017, from corresponding GB Patent Application No. GB1617016.9.

International Search Report and Written Opinion dated Nov. 17, 2017 from corresponding International Patent Application No. PCT/US2017/050850.

* cited by examiner

*Primary Examiner* — Huyen X Vo

(57) ABSTRACT

Speech in a motor vehicle is improved by suppressing transient, "non-stationary" noise using pattern matching. Pre-stored sets of linear predictive coefficients are compared to LPC coefficients of a noise signal. The pre-stored LPC coefficient set that is "closest" to an LPC coefficient set representing a signal comprising speech and noise is considered to be noise.

5 Claims, 10 Drawing Sheets

ROBUST NOISE ESTIMATION FOR SPEECH ENHANCEMENT IN VARIABLE NOISE CONDITIONS

BACKGROUND

Speech enhancement systems in a motor vehicle must of course contend with low signal-to-noise ratio (SNR) conditions, but they must also contend with different kinds of noise, some of which is considered to be transient or "non-stationary." As used herein, non-stationary vehicle noise includes but is not limited to, transient noises due to vehicle acceleration, traffic noises, road bumps, and wind noise.

Those of ordinary skill in the art know that conventional prior art speech enhancement methods are "retrospective:" they rely on detection and analysis of noise signals that have already occurred in order to suppress noise that is present or expected to occur in the future, i.e., noise that has yet to happen. Prior art noise suppression methods thus assume that noise is stable or "stationary" or at least pseudo-stationary, i.e. the noise power spectrum density (PSD) is stable and therefore closely approximated or estimated via a slow temporal smoothing over the noise detected.

When a background noise occurs suddenly and unexpectedly, as happens when a vehicle strikes a road surface imperfection for example, conventional prior art noise detection/estimation methods are unable to quickly differentiate noise from speech but require instead, significant amounts of future samples that are yet to happen. Traditional speech enhancement techniques are therefore inherently inadequate to suppress so-called non-stationary noises. A method and apparatus for detecting and suppressing such noise would be an improvement over the prior art.

SUMMARY

To be succinct, elements of a method and apparatus to quickly detect and suppress transient, non-stationary noise in an audio signal are set forth herein. The method steps are performed in the frequency domain.

As a first step, a noise model based on a linear predictive coding (LPC) analysis of a noisy audio signal is created.

A voice activity detector (VAD) is derived from a probability of speech presence (SPP) for every frequency analyzed. As a second step, the noise model created in the first step is updated at the audio signal's frame rate, if voice activity detection (VAD) permits.

It should be noted that, the "order" of the LPC analysis is preferably a large number (e.g. 10 or higher), which is considered herein as being "necessary" for speech. Noise components, on the other hand, are represented equally well with a much lower LPC model (e.g. 4 or lower). In other words, the difference of between higher order LPC and lower order LPC is significant for speech, but it is not the case for noise. This differentiation provides a mechanism of instantaneously separate noise from speech, regardless of energy level presented in the signal.

As a third step, a metric of similarity (or di-similarity) between higher and lower order LPC coefficients is calculated at each frame. After the metric is calculated, a second metric of "goodness of fit" of the higher order parameters between on-line noise model and LPC coefficients is calculated at each frame.

A "frame" of noisy, audio-frequency signal is classified as noise if the two metrics described above are both less than their individual pre-calculated thresholds. Those thresholds used in the decision logic are calculated as part of noise model.

If a noise classifier identifies the current frame of signal as noise, the noise PSD (power spectral density), i.e. noise estimate, is calculated, or refined if there exists also a separate noise estimation based on other speech/noise classification methods (e.g. voice activity detection (VAD) or probability of speech presence).

The noise classifier and noise model are created "on-the-fly", and do not need any "off-line" training.

The calculation of the refined noise PSD is based on the probability of speech presence. A mechanism is built in so that the noise PSD is not over-estimated if the conventional method already did that (e.g. in stationary noise condition). The probability of speech determines how much the noise PSD is to be refined at each frame.

The refined noise PSD is used for SNR recalculation ($2^{nd}$ stage SNR).

Noise suppression gain function is also recalculated ($2^{nd}$ stage gain) based on the refined noise PSD and SNR.

Finally the refined gain function ($2^{nd}$ stage NS) is applied to noise suppression operation.

DETAILED DESCRIPTION

As used herein, the term "noise" refers to signals, including electrical and acoustic signals, comprising several frequencies and which include random changes in the frequencies or amplitudes of those frequencies. According to the I.E.E.E. Standards Dictionary, Copyright 2009 by I.E.E.E., one definition of "noise" is that it comprises "any unwanted electrical signals that produce undesirable effects in the circuits of a control system in which they occur." For a hands-free voice communications system in the vehicle, acoustic noise is generated by engine, tires, roads, wind and traffic nearby.

Figure 1:
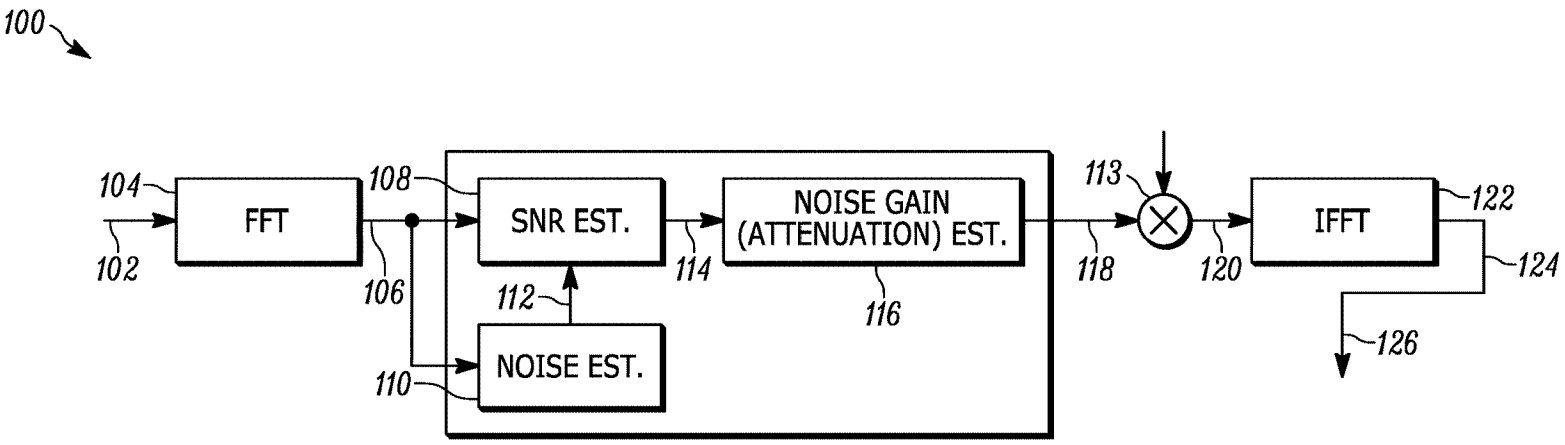
PRIOR ART FIG. 1
FIG. 1 is a block diagram of a prior art noise estimator and suppressor.

FIG. 1 depicts a block diagram of a prior art noise estimator 100. A noisy signal 102, comprising speech and noise is provided to a fast Fourier transform processor 104 (FFT 104). The output 106 of the FFT processor 104 is provided to a conventional signal-to-noise ratio (SNR) estimator 108 and a noise estimator 110. The output 106 is converted to an attenuation factor (suppression gain) 118.

The signal-to-noise ratio (SNR) estimator 108 is provided with an estimate of the noise content 112 of the noisy signal 102. The estimator 108 also provides a signal-to-noise ratio estimate 114 to a noise gain amplifier/attenuator 116.

The SNR estimator 108, noise estimator 110 and the attenuator 116 provide an attenuation factor 118 to a multiplier 113, which receives copies of the FFTs of the noisy audio signal 102. The product 120 of the attenuation factor 118 and the FFTs 106 are essentially a noise-suppressed frequency-domain copy of the noisy signal 102.

An inverse Fourier transform (IFFT) 122 is performed the output 124, which is a time-domain, noise-suppressed "translation" of the noisy signal 102 input to the noise estimator 100. A "de-noised" signal 126 is improved, with respect to noise level and speech clarity. The signal 126 can still have non-stationary noise components embedded in it because the noise estimator 100 is not able to quickly respond to transient or quickly-occurring noise signals.

Figure 2:
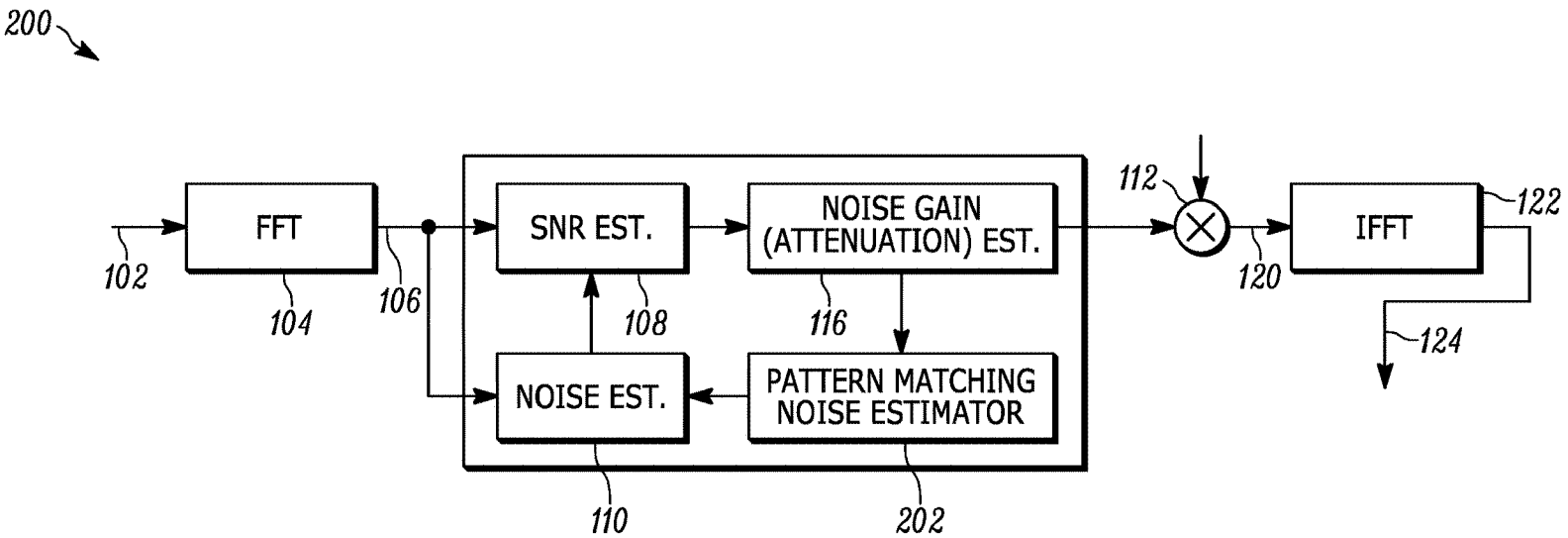
FIG. 2 is a block diagram of an improved noise estimator, configured to detect and suppress non-stationary noises such as the transient noise caused by sudden acceleration, vehicle traffic or road bumps.

FIG. 2 is a block diagram of an improved noise estimator 200. The noise estimator 200 shown in FIG. 2 is essentially the same as the noise estimator shown in FIG. 1 except for the addition of a linear predictive code (LPC) pattern-matching noise estimator 202, configured to detect and respond to fast or quickly-occurring noise transients using pattern matching of noise representations with a frequency domain copy of the noisy signal 102 input to the system, as well as an analysis of similarity metric between a higher order LPC and a lower order LPC on the same piece of signal (frame). The system 200 shown in FIG. 2 differs by the similarity metric and the pattern matching noise estimator 202 receiving information from the prior art components shown in FIG. 1 and producing an enhanced or revised estimate of transient noise.

Figure 3:
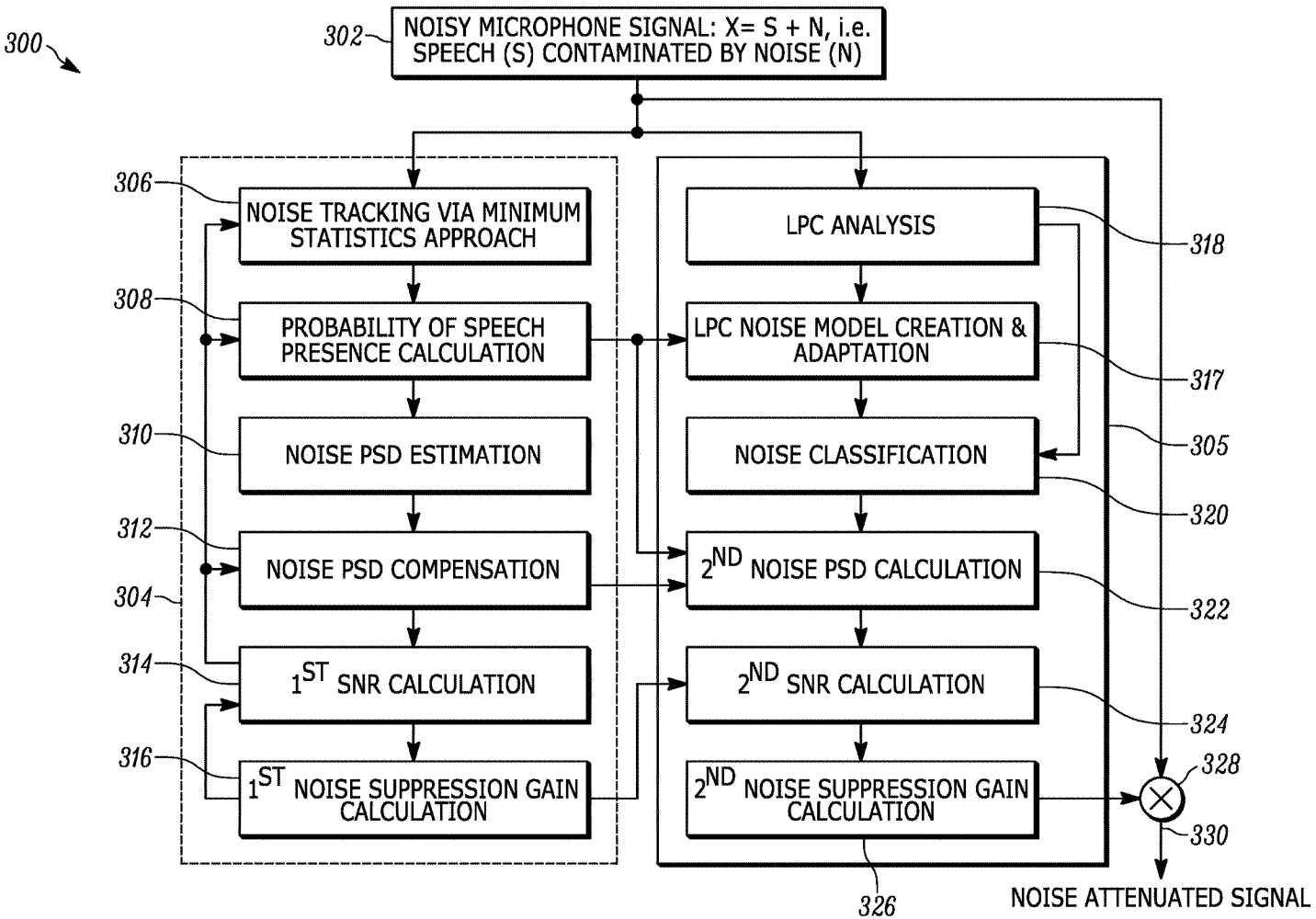
FIG. 3 is a flowchart depicting steps of a method for enhancing speech by estimating non-stationary noise in variable noise conditions.

FIG. 3 depicts steps of a method of enhancing speech by estimating transient noise in variable noise conditions. The method begins at step 302, where a noisy microphone signal, X, made of speech and noise is detected by a microphone. Stated another way, the noisy signal from the microphone, X=S+N, where "S" is speech and "N" is a noise signal.

The noisy signal, X, is processed using conventional prior art noise detection steps 304 but the noisy signal, X, is also processed by new steps 305 that essentially determine whether a noise should also be suppressed by analyzing the similarity metric or a "distance" between a higher order LPC and a lower order LPC, as well as comparing the LPC content of the noisy signal X, to the linear predictive coefficients (LPCs) of the noise model, that are created and updated on the fly. Signal X is classified as either noise or speech at step 320. Referring now to the prior steps, at the step identified by reference numeral 306, noise characteristics are determined using statistical analysis. At step 308, a speech presence probability is calculated. At step 310, noise estimate in the form of power spectral density or PSD, is calculated.

A noise compensation is calculated or determined at step 312 using the power spectral density.

In steps 314 and 316, a signal-to-noise ratio (SNR) is determined and an attenuation factor determined.

Referring now to the new steps enclosed within the bracket identified by reference numeral 305, at step 318 a linear predictive coefficient analysis is performed on the noisy signal X. Under the condition that X is interpreted as noise by step 308, the result of the LPC analysis at step 318 is provided to the LPC noise model creation and adaptation step 317, the result of which is the creation of a set of LPC coefficients which model or represent ambient noise over time. The LPC noise model creation and adaptation step thus creates a table or list of LPC coefficient sets, each set of which represents a corresponding noise, the noise represented by each set of LPC coefficients being different from noises represented by other sets of LPC coefficients.

The LPC analysis step 318 produces a set of LPC coefficients that represent the noisy signal. Those coefficients are compared against the sets of coefficients, or online noise models, created over time in a noise classification step 320. (As used herein, the term, "on line noise model" refers to a noise model created in "real time." And, "real time" refers to an actual time during which an event or process takes place.) The noise classification step 320 can thus be considered to be a step wherein the LPC coefficients representing the speech and noise samples from the microphone. The first set of samples received from the LPC analysis represents thus an audio component and a noise signal component.

Apart from a higher order (e.g. $10^{th}$) LPC analysis, a lower order (e.g. $4^{th}$) LPC is also calculated for the input X at step 318. A log spectrum distance measure between two spectra that corresponds to the two LPC is served as the metric of similarity between the two LPCs. Due to lacking of inherent spectrum structure or unpredictability nature in the noise case, the distance metric is expected to be small. On the other hand, the distance metric is relatively large if signal under analysis in speech.

The log spectrum distance is approximated with the Euclidean distance of two sets of cepstral vectors. Each cepstral vector is converted from its corresponding (higher or lower) LPC coefficients. As such, the distance in the frequency domain can be calculated without actually involving a computation intensive operation on the signal X.

The log spectrum distance, or cepstral distance, between the higher and lower order LPC is calculated at frame rate, the distance, and its variation over time, are compared against a set of thresholds at step 320. Signal X is classified as speech if the distance and its trajectory are beyond certain thresholds. Otherwise it is classified as noise.

The result of the noise classification, is provided to a second noise calculation in the form of power spectral density or PSD. To control the degree of the noise PSD refinement, the second PSD noise calculation at step 322 receives as inputs, the first speech presence probability calculation of step 308 and a noise compensation determination of step 312.

The second noise calculation using power spectral density or PSD is provided to a second signal-to-noise ratio calculation at step 324 which also uses the first noise suppression gain calculation obtained at step 316. A second noise suppression gain calculation is performed at 326, which is provided to a multiplier 328, the output signal 330 of which is a noise-attenuated signal, the attenuated noise including transient or so-called non-stationary noise.

Figure 4:
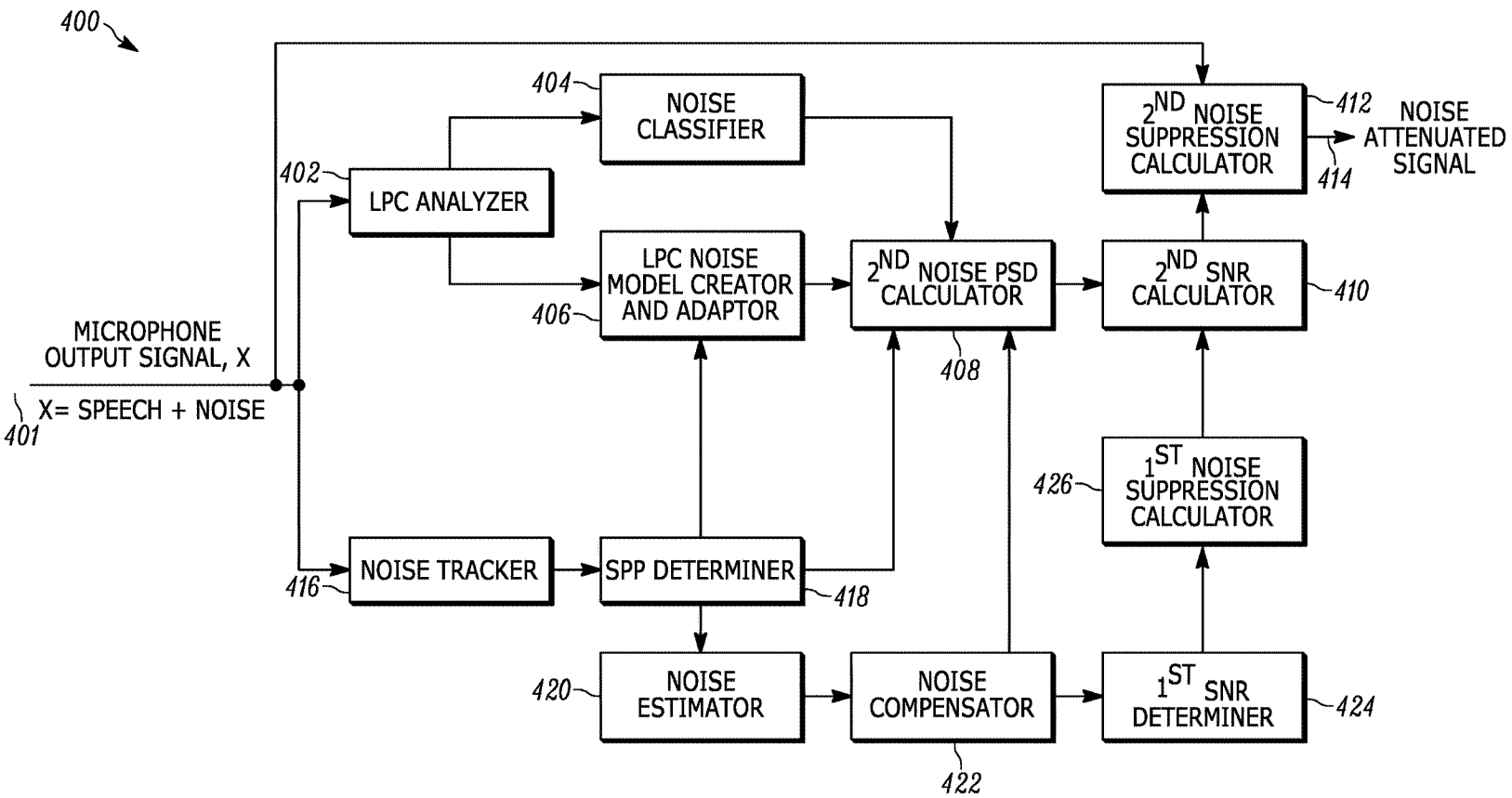
FIG. 4 is a block diagram of an apparatus for quickly estimating non-stationary noise in variable noise conditions.

Referring now to FIG. 4, an apparatus for enhancing speech by estimating transient or non-stationary noise includes a set of components or processor, coupled to a non-transitory memory device containing program instructions which perform the steps depicted in FIG. 3. The apparatus 400 comprises an LPC analyzer 402.

The output of the LPC analyzer 402 is provided to a noise classifier 404 and an LPC noise model creator and adapter 406. Their outputs are provided to a second PSD calculator 408.

The second PSD noise calculator 408 updates a calculation of the noise power spectral density (PSD) responsive to the determination that the noise in the signal X, is non-stationary, and which is made by the noise classifier 404. The output of the second noise PSD calculator is provided to a second signal-to-noise ratio calculator 410. A second noise suppression calculator 412 receives the noisy microphone output signal 401 and the output of the second SNR calculator 410 and produces a noise attenuated output audio signals 414.

Still referring to FIG. 4, the noise suppressor includes a prior art noise tracker 416 and a prior art SPP (speech probability determiner) 418. A noise estimator 420 output is provided to a noise compensator 422.

A first noise determiner 424 has its output provided to a first noise compensation or noise suppression calculator 426, the output of which is provided to the second SNR calculator 410.

A method is disclosed herein of removing embedded acoustic noise and enhancing speech by identifying and estimating noise in variable noise conditions. The method comprises: A speech/noise classifier that generates a plurality of linear predictive coding coefficient sets, modelling incoming frame of signal with a higher order LPC and lower order LPC; A speech/noise classifier that calculates the log spectrum distance between the higher order and lower order LPC resulting from the same frame of signal. The log spectrum distance is calculated by two set of cepstral coefficient sets derived from the higher and lower order LPC coefficient sets; A speech/noise classifier that compares the distance and its short time trajectory against a set of thresholds to determine the frame of signal being speech or noise; The thresholds used for the speech/noise classifier is updated based on the classification statistics and/or in consultation with other voice activity detection methods; generating a plurality of linear predictive coding (LPC) coefficient sets as on line created noise models at run time. each set of LPC coefficients representing a corresponding noise, Noise model is created and updated under conditions that the current frame of signal is classified as noise by conventional methods (e.g. probability of speech presence) or the LPC speech/noise classifier;a separate but parallel noise/speech classification is also put in place based on evaluating the distance of the LPC coefficients of the input signal against the noise models represented by LPC coefficients sets. If the distance is below a certain threshold, the signal is classified as noise, otherwise speech; A conventional noise suppression method, such as MMSE utilizing probability of speech presence, carries out noise removal when ambient noise is stationary; A second noise suppressor comprising LPC based noise/speech classification refines (or augmented) noise estimation and noise attenuation when ambient noise is transient or non-stationary; the second step noise estimation takes into account of the probability of speech presence and adapt accordingly the noise PSD in the frequency domain wherever the conventional noise estimation fails or is incapable of; the second step noise estimation using probability of speech presence also prevents over-estimation of the noise PSD, if the conventional method already works in stationary noise conditions; Under the condition that the signal is classified as noise by the LPC based classifier, the amount of noise update (refinement) in the second stage is proportional to the probability of speech presence, i.e. the larger the probability of speech is, the larger amount of noise update occurs; SNR and Gain functions are both re-calculated and applied to the noisy signal in the second stage noise suppression; when the conventional method identifies the input as noise with a high degree of confidence, the second stage of noise suppression will do nothing regardless the results of the new speech/noise classification and noise re-estimate. On the other hand, additional noise attenuation can kick-in quickly even if the conventional (first stage) noise suppression is ineffective on a suddenly increased noise; the re-calculated noise PSD from the "augmented" noise classification/estimation is then used to generate a refined set of noise suppression gains in frequency domain.

Those of ordinary skill in the art should recognize that detecting noise and a noisy signal using pattern matching is computationally faster than prior art methods of calculating linear predictive coefficients, analyzing the likelihood of speech being present, estimating noise and performing a SNR calculation. The prior art methods of noise suppression, which are inherently retrospective, is avoided by using current or nearly real-time noise determinations. Transient or so-called non-stationary noise signals can be suppressed in much less time than the prior art methods required.

To remove noise effectively, a noise suppression algorithm should correctly classify an input signal as noise or speech. Most conventional voice activity detection (VAD) algorithms estimate the level and/or variation of the energy from an audio input in a real time manner, and compare the energy measured at present time with the energy of a noise estimated in the past. The signal to noise ratio (SNR) measurement and values examination are the pillar for numerous VAD methods, and it works relatively well when ambient noise is stationary; after all, the energy level during speech presence is indeed larger compared to the energy level when speech is absent, if the noise background remains stationary (i.e., relatively constant).

However, this assumption and mechanism are no longer valid, if the noise level suddenly increases in non-stationary or transient noise conditions, such as during car acceleration, wind noise, traffic passing, etc. When noise suddenly increases, the energy measured is significantly larger than the noise energy estimated in the past. A SNR based VAD method can therefore easily fail or require a significant amount of time to make a decision. The dilemma is that a delayed detection, even though it is correct, is essentially useless for transient noise suppression in an automotive vehicle.

A parametric model, in accordance with embodiments of the invention, is proposed and implemented to augment the weakness of the conventional energy/SNR based VADs.

Noise in general is unpredictable in time, and its spectral representation is monotone and lacks structure. On the other hand, human voices are somewhat predictable using a linear combination of previous samples, and the spectral representation of a human voice is much more structured, due to effects of vocal tract (formants, etc.) and vocal cord vibration (pitch or harmonics).

These differences of noise and voice are characterized well through linear predictive coding (LPC). In fact, noise signal can be modelled almost equally well by a higher order LPC (e.g. 10th order) or a lower order LPC (4th order). On the other hand, a higher order LPC (10th or higher) should be used to characterize a voiced signal. A lower order (e.g.

4th) LPC lacks the complexity and modelling power and is therefore not adequate for voice signal characterization.

Figure 5:
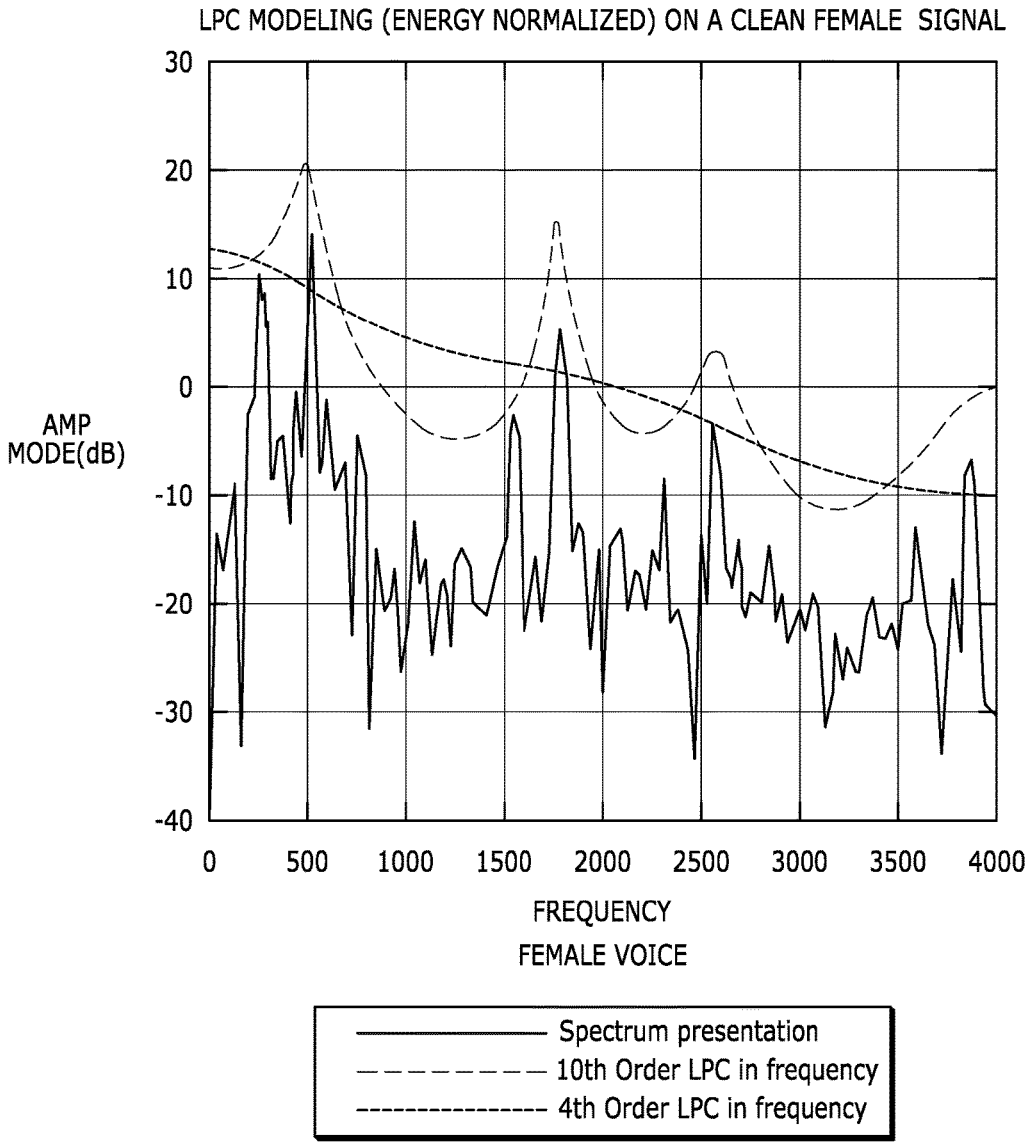
FIG. 5 depicts spectra converted from a higher and lower LPC models, along with the detailed spectrum of signal itself, for a female voice.

FIG. 5 depicts spectra converted from a higher and lower LPC models, along with the detailed spectrum of signal itself, for a female voice.

Figure 6:
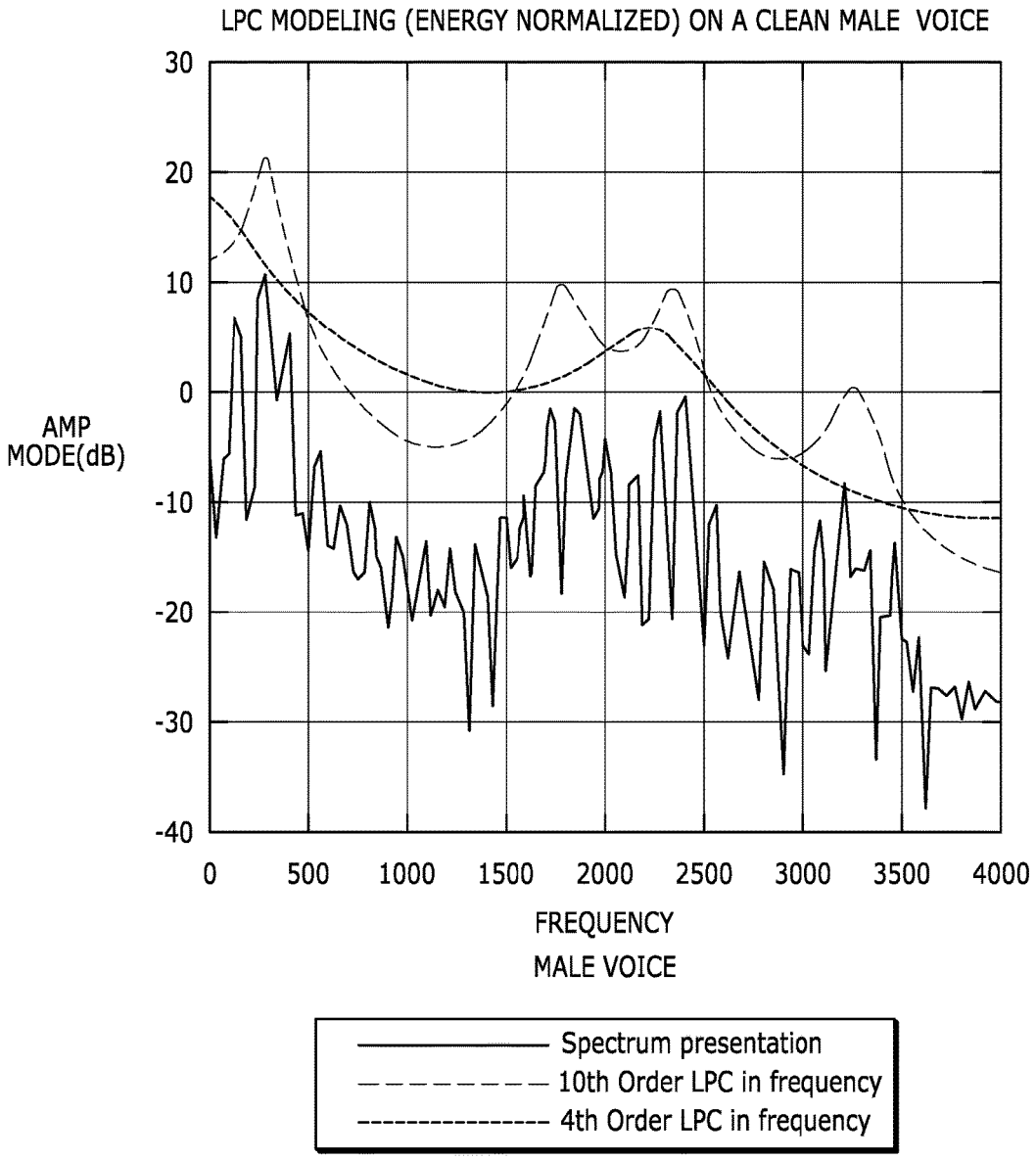
FIG. 6 depicts spectra converted from a higher and lower LPC models, along with the detailed spectrum of signal itself, for a male voice.

FIG. 6 depicts spectra converted from a higher and lower LPC models, along with the detailed spectrum of signal itself, for a male voice.

Figure 7:
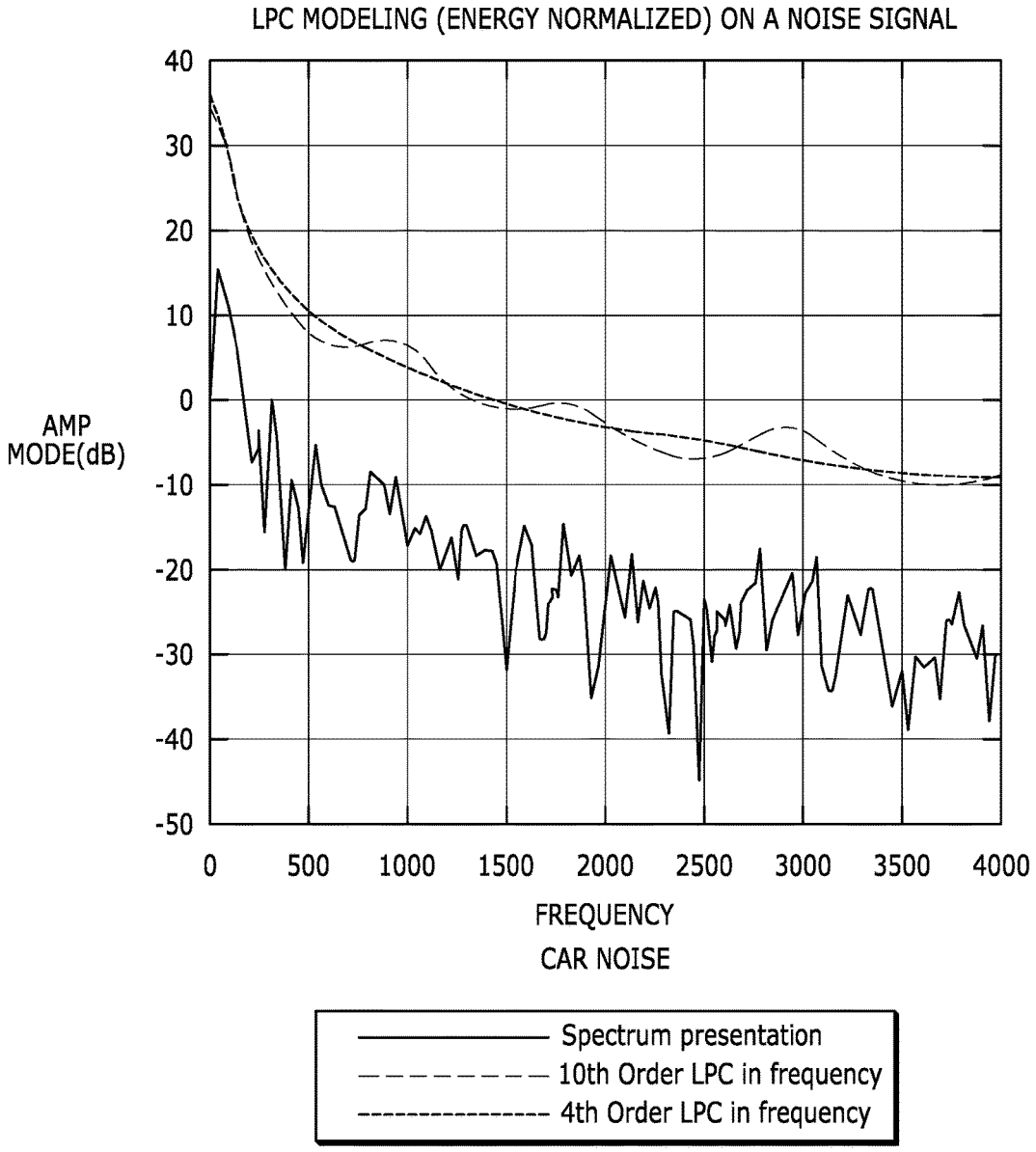
FIG. 7 depicts spectra converted from a higher and lower LPC models, along with the detailed spectrum of signal itself, for car noise (e.g., engine noise, road noise from tires, and the like).

FIG. 7 depicts spectra converted from a higher and lower LPC models, along with the detailed spectrum of signal itself, for car noise (e.g., engine noise, road noise from tires, and the like).

Figure 8:
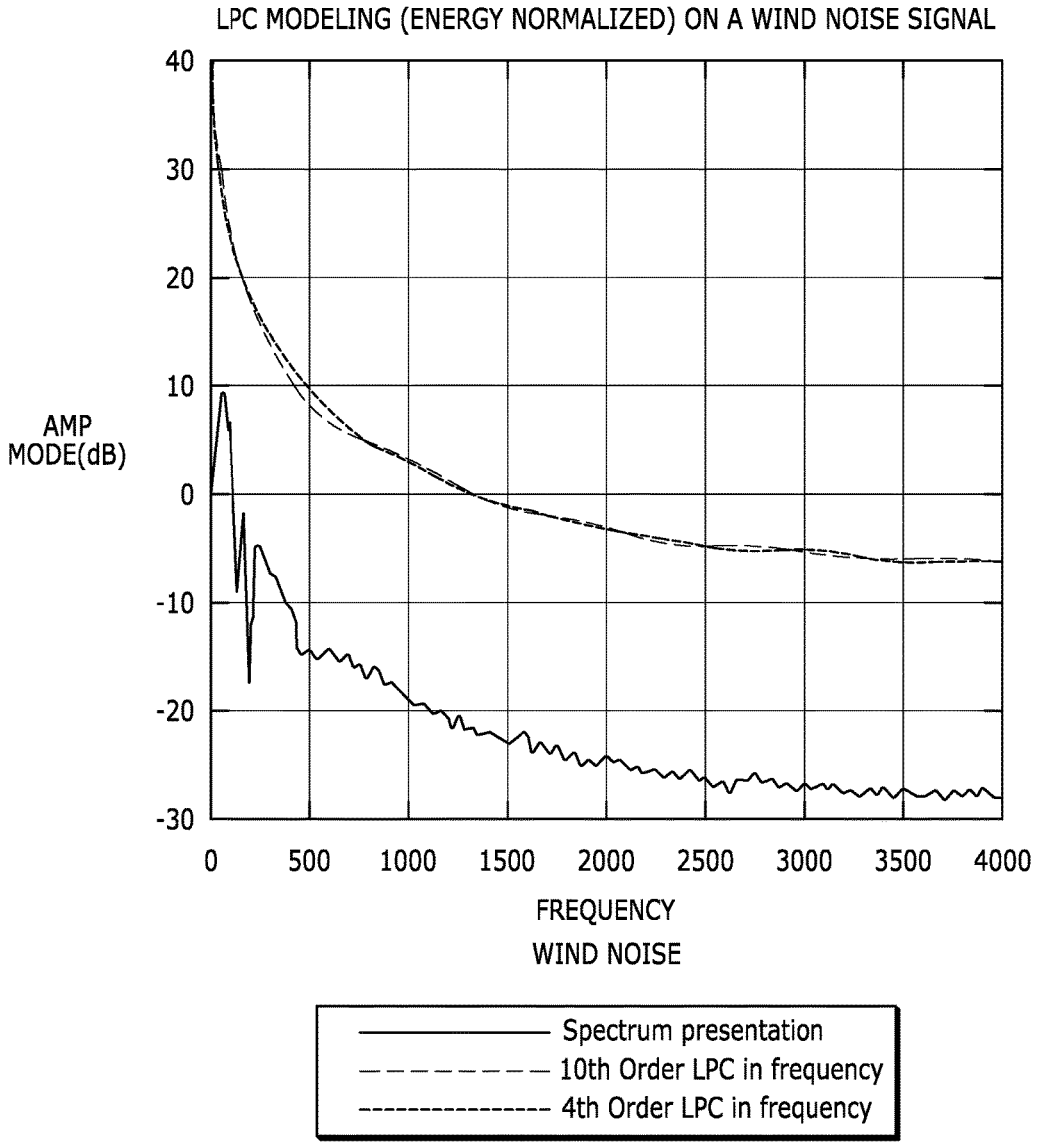
FIG. 8 depicts spectra converted from a higher and lower LPC models, along with the detailed spectrum of signal itself, for wind noise.

FIG. 8 depicts spectra converted from a higher and lower LPC models, along with the detailed spectrum of signal itself, for wind noise.

As shown in FIGS. 5-8, due to the formant structure and frequency characteristics of a voiced signal, the spectral difference between the higher and lower order LPC is significant. On the other hand, for noise, the difference is small, sometimes very small.

This type of analysis provides a robust way to differentiate noise from speech, regardless the energy level a signal carries with.

Figure 9:
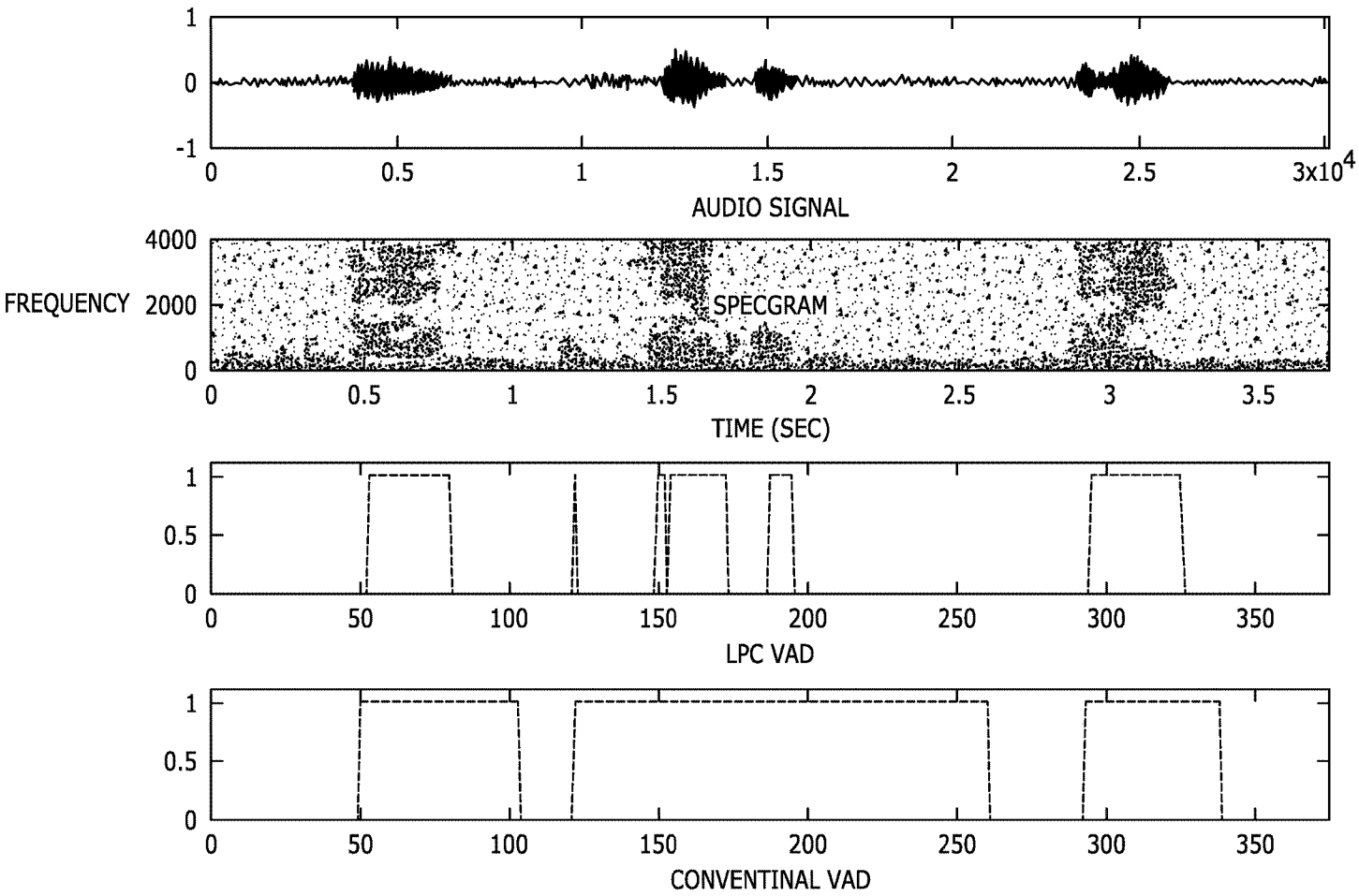
FIG. 9 depicts results generated by an energy-independent voice activity detector in accordance with embodiments of the invention.

FIG. 9 depicts results generated by an energy-independent voice activity detector in accordance with embodiments of the invention and results generated by a sophisticated conventional energy-dependent voice activity detector. In FIG. 9, a noisy input is depicted in both the time and frequency domains. The purpose of a VAD algorithm is to correctly identify an input as noise or speech in real time (e.g., during each 10 millisecond interval). In FIG. 9, a VAD level of 1 indicates a determination that speech is present, while a VAD level of zero indicates a determination that speech is absent.

An LPC VAD (also referred to herein as a parameteric model based approach) in accordance with embodiments of the invention outperforms the conventional VAD when noise, but not speech, is present. This is particularly true when the background noise is increased during the middle portion of the audio signal sample shown in FIG. 9. In that situation, the conventional VAD fails to identify noise, while the LPC_VAD correctly classifies speech and noise portions of the input noisy signal.

Figure 10:
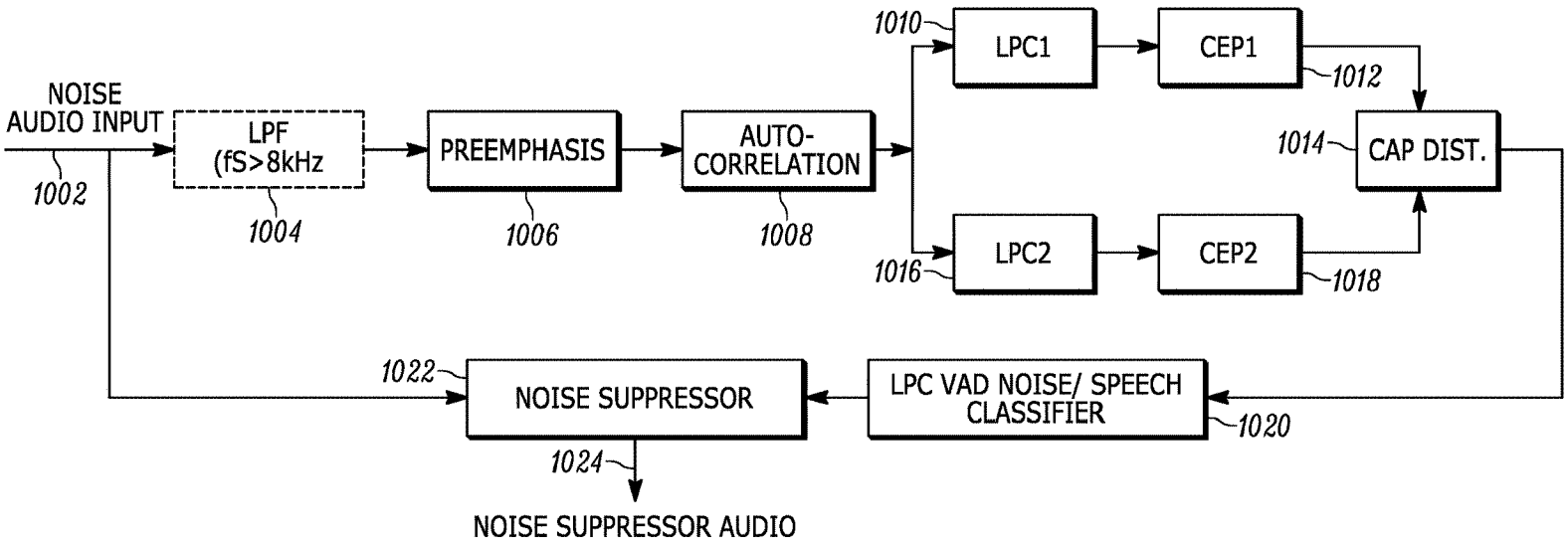
FIG. 10 is a schematic diagram of noise-suppression system including a linear predictive coding voice activity detector in accordance with embodiments of the invention.

FIG. 10 is a schematic diagram of noise-suppression system including a linear predictive coding voice activity detector (also referred to herein as a parametric model) in accordance with embodiments of the invention. Shown in FIG. 10 is a noisy audio input 1002, a low pass filter 1004, a pre-emphasis 1006, an autocorrelation 1008, an LPC1 1010, a CEP1 1012, and CEP Distance determiner 1014, an LPC2 1016, a CEP2 1018, an LPC VAD Noise/Speech Classifier 1020, a noise suppressor 1022, and a noise suppressed audio signal 1024.

An optional low pass filter with cut off frequency of 3 kHz is applied to the input.

A pre-emphasis is applied to the input signal, $$s(n),\ 0 \le n \le N-1,$$

the pre-emphasis is to lift high frequency content so that high frequency spectrum structure is emphasized, i.e.

$$s(n)=s(n)-\mu s(n-1),\ 0.5 \le \mu \le 0.9.$$

Calculate a sequence of auto-correlations of the pre-emphasized input.

Apply first higher order LPC analysis and calculate a longer set of LPC (e.g. order 10) coefficients $$\text{(LPC1)}\ s(n) \approx \Sigma_{i=1}^{P} a_i s(n-i)$$

Apply second higher order LPC analysis and calculate a shorter set of LPC (e.g. order 4) coefficients (LPC2)

$$s(n) \approx \sum_{i=1}^{Q} a_i' s(n-i)$$

Cast the two sets of LPC coefficients $$A_P=[a_0, a_1, \ldots a_P], \text{ and}$$

$$A_Q=[a'_0, a'_1, \ldots a'_Q],$$

to spectral domain (transfer function), i.e.

$$H_P = \frac{1}{\sum_{i=1}^{P} a_i z^{-i}},\ H_Q = \frac{1}{\sum_{i=1}^{Q} a_i' z^{-i}}$$

Discard the energy term in the transfer functions above, therefore the spectrum representations of two LPC models are energy normalized or independent.

Choose the log spectrum distance as a meaningful metric to measure the similarity of two spectral curves.

Calculate the log spectrum distance between two spectra corresponding to the two transfer functions, i.e.

$$D(H_P, H_Q) = \int_0^{\pi} [\log H_P(\omega) - \log H_P(\omega)]^2 d\omega$$

Approximate the log spectrum distance with Euclidean cepstrum distance, in order to greatly reduce the considerable computation load needed, i.e.

$$D(H_P, H_Q) = \int_0^{\pi} [\log H_P(\omega) - \log H_P(\omega)]^2 d\omega \approx \sum_{m=1}^{M} (c_m - c_m')^2$$

In order to accomplish choosing the log spectrum distance as a meaningful metric to measure the similarity of two spectral curves, two sets of cepstrum coefficients, C and C' corresponding to $A_P$ and $A_Q$ (CEP1 and CEP2)

$$C = [c_1, c_2, \ldots c_M], \text{ and } C' = [c_1', c_2', \ldots c_M'],\ M > \max(P, Q)$$

$$c_m = -a_m - \frac{1}{m}\sum_{k=1}^{m-1} [(m-k)a_k c_{(m-k)}],\ 1 \le m \le P$$

$$c_m = -\frac{1}{m}\sum_{k=1}^{P} [(m-k)a_k c_{(m-k)}],\ P < m \le M$$

VAD decision making logic determines each frame of input signal as speech or noise as follows: if $D(H_P, H_Q)$<THRESHOLD_NOISE , then signal is classified as noise (i.e. VAD=0); else if $D(H_P, H_Q)$>THRESHOLD_SPEECH, then signal is classified as speech; else signal is classified the same as previous frame, or determined by a different approach.

The foregoing description is for purposes of illustration only. The true scope of the invention is set forth in the following claims.

What is claimed is:

1. An apparatus comprising:

a linear predictive coding voice activity detector configured to:

low pass filter an input signal;

apply a pre-emphasis to high frequency content of the input signal so that a high frequency spectrum structure of the low-pass-filtered input signal is emphasized;

calculate a sequence of auto-correlations of the pre-emphasized low-pass-filtered input signal;

apply a first higher order linear predictive coding ("LPC") analysis and calculate a longer set of LPC coefficients;

apply a second higher order LPC analysis and calculate a shorter set of LPC coefficients;

cast the longer set of LPC coefficients and the shorter set of LPC coefficients to the spectral domain;

energy normalize the spectral domain representations of the longer set of LPC coefficients and the shorter set of LPC coefficients;

determine a log spectrum distance between the energy normalized spectral domain representations of the longer set of LPC coefficients and the shorter set of LPC coefficients;

determine whether a frame of the input signal is noise based on whether the determined log spectrum distance between the energy normalized spectral domain representations of the longer set of LPC coefficients and the shorter set of LPC coefficients is less than a noise threshold; and when the frame of the input signal is determined not to be noise, determining whether the frame of the input signal is speech based on whether the determined log spectrum distance between the energy normalized spectral domain representations of the longer set of LPC coefficients and the shorter set of LPC coefficients is greater than a speech threshold; and a noise suppressor that accepts as inputs both the input signal to the linear predictive coding voice activity detector and a determination from the linear predictive coding voice activity detector as to whether the frame includes noise or speech, and wherein the noise suppressor generates, based on both of those inputs, a noise-suppressed signal that quickly responds to transient noise signals.

2. The apparatus of claim 1 wherein the low pass filter a cut off frequency of 3kHz.

3. The apparatus of claim 1, wherein the longer set of LPC coefficients has an order of 10 or more.

4. The apparatus of claim 1, wherein the shorter set of LPC coefficients having an order of 4 or fewer.

5. The apparatus of claim 1, wherein the log spectrum distance is approximated with Euclidean cepstrum distance to reduce an associated computational load.

* * * * *